United States Patent [19]

Scidmore et al.

[11] Patent Number: 4,674,651

[45] Date of Patent: Jun. 23, 1987

[54] PILL DISPENSER

[76] Inventors: Fred A. Scidmore; Mamie Scidmore, both of R.R. 1, Box 176; Donald Scidmore, R.R. 1, Box 172A, all of Holcombe, Wis. 54745

[21] Appl. No.: 799,353

[22] Filed: Nov. 15, 1985

[51] Int. Cl.[4] ..... B65D 83/04

[52] U.S. Cl. ..... 221/3; 221/9; 221/15; 221/82; 221/281

[58] Field of Search ..... 221/2–3, 221/5, 9, 12, 15, 82, 83, 155, 281

[56] References Cited

U.S. PATENT DOCUMENTS

| | | | |
|---|---|---|---|
| 3,369,697 | 2/1968 | Glucksman et al. | 221/3 X |
| 3,727,794 | 4/1973 | Dieranco | 221/3 |
| 3,998,356 | 12/1976 | Christensen | 221/2 |
| 4,207,992 | 6/1980 | Brown | 221/15 |
| 4,223,801 | 9/1980 | Carlson | 221/3 |
| 4,572,403 | 2/1986 | Benaroya | 221/3 |

*Primary Examiner*—Charles A. Marmor

*Attorney, Agent, or Firm*—Berman, Aisenberg & Platt

[57] ABSTRACT

An apparatus for dispensing pills wherein a rotating annular element includes a number of compartments for receiving pills. When a compartment is above an opening in the base, the pills fall into a chute and are dispensed. A pin is associated with each compartment and is placed in an activated position when pills are loaded into the compartment. When the compartment is above the dispensing opening, a pin engages a microswitch which activates audio and visual alarms. The alarms are deactivated by depressing a shut-off switch which operates a delay-type relay. A trapdoor is rotatably mounted beneath the dispensing opening and is operated by the lid of the apparatus so that in the loading position, the dispensing opening is locked.

4 Claims, 4 Drawing Figures

FIG. 3.
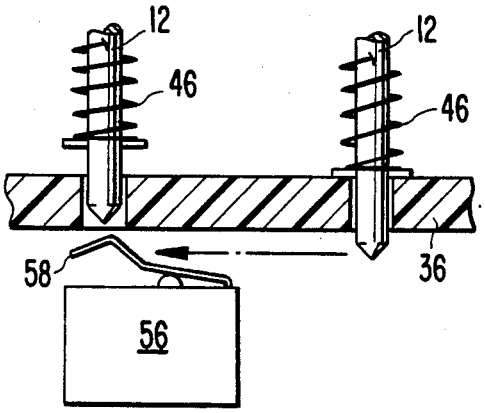
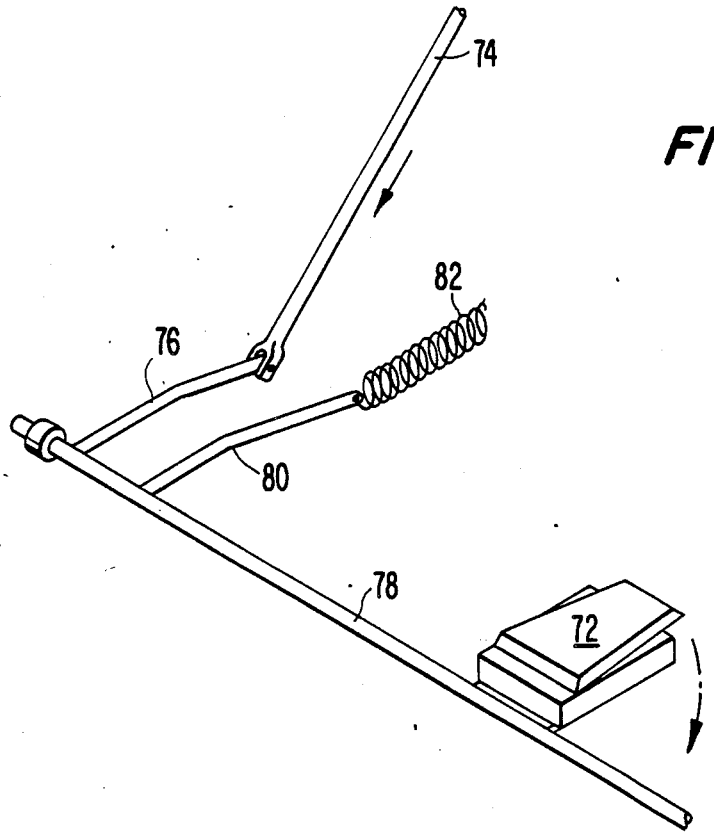
FIG. 4.

PILL DISPENSER

TECHNICAL FIELD

This invention relates to the art of dispensers. In particular, the invention is an apparatus for dispensing pills at selected times and for simultaneously indicating the dispensing by activation of appropriate alarms.

BACKGROUND ART

It is common for certain persons to take a variety of pills for treatment of various conditions. Typically, the pills are taken at spaced intervals throughout the day, and it is often necessary to take different combinations of pills at different intervals throughout the day.

Keeping track of the pills to be taken can become very cumbersome, particulary for an aged or disabled patient. Accordingly, various devices have been developed for dispensing pills or for alerting a patient to the necessity of taking a pill.

Devices such as those shown in U.S. Pat. Nos. 3,815,780 (Bauer) and 4,207,992 (Brown) use rotatable trays having a plurality of compartments for receiving pills. When a tray is aligned with a dispensing chute, the pills fall into the chute and are thus available to the patient.

Other dispensing systems are shown in U.S. Pat. Nos. 3,395,829 (Cogdell, et al.), 3,968,900 (Stambuk), and 4,223,801 (Carlson).

SUMMARY OF THE INVENTION

The above prior devices are either quite complex or fail to provide an adequate alarm to advise a patient that it is time to take one or more pills. According to the invention, an apparatus is provided wherein a plurality of compartments is located in a rotating element. Each compartment holds one or more pills and is open at its top and bottom. The compartments are held adjacent a surface of the base of the apparatus so that the pills are retained in the compartments until a single compartment is aligned with an opening in the base, whereupon the pills fall into a dispensing chute. In a like manner, the compartments are covered by a stationary plate having a single opening which permits pills to be placed into a selected compartment.

A plurality of pins is carried with the rotating element and individual pins may be placed in an active or inactive position by simple manipulation of a cam. When a pin is in an active position, it will engage a switch when a compartment is in a selected position to cause activation of audible and visual alarms.

A lid covers the compartment when the device is operating, and when the lid is raised for re-loading the compartments with medicine, a door closes the opening in the base thus preventing pills from being dispensed. A clutch is provided between an electric motor and the rotating element to allow the compartments to be easily moved during loading.

It is an object of this invention to provide an inexpensive dispensing mechanism which provides an alarm at selected dispensing times.

Another object of this invention is to provide a dispensing mechanism wherein an element having compartments carries a plurality of selectively activatable pins for initiating an alarm.

Yet another object of this invention is to provide a dispensing mechanism wherein a lid is connected to a door for preventing dispensing of pills during a loading operation.

BRIEF DESCRIPTION OF THE DRAWINGS

FIG. 3 is a section taken along line 3—3 of FIG. 2.

FIG. 4 is a perspective view of a mechanism connecting a lid with a moveable door

DETAILED DESCRIPTION OF THE INVENTION

Figure 1:
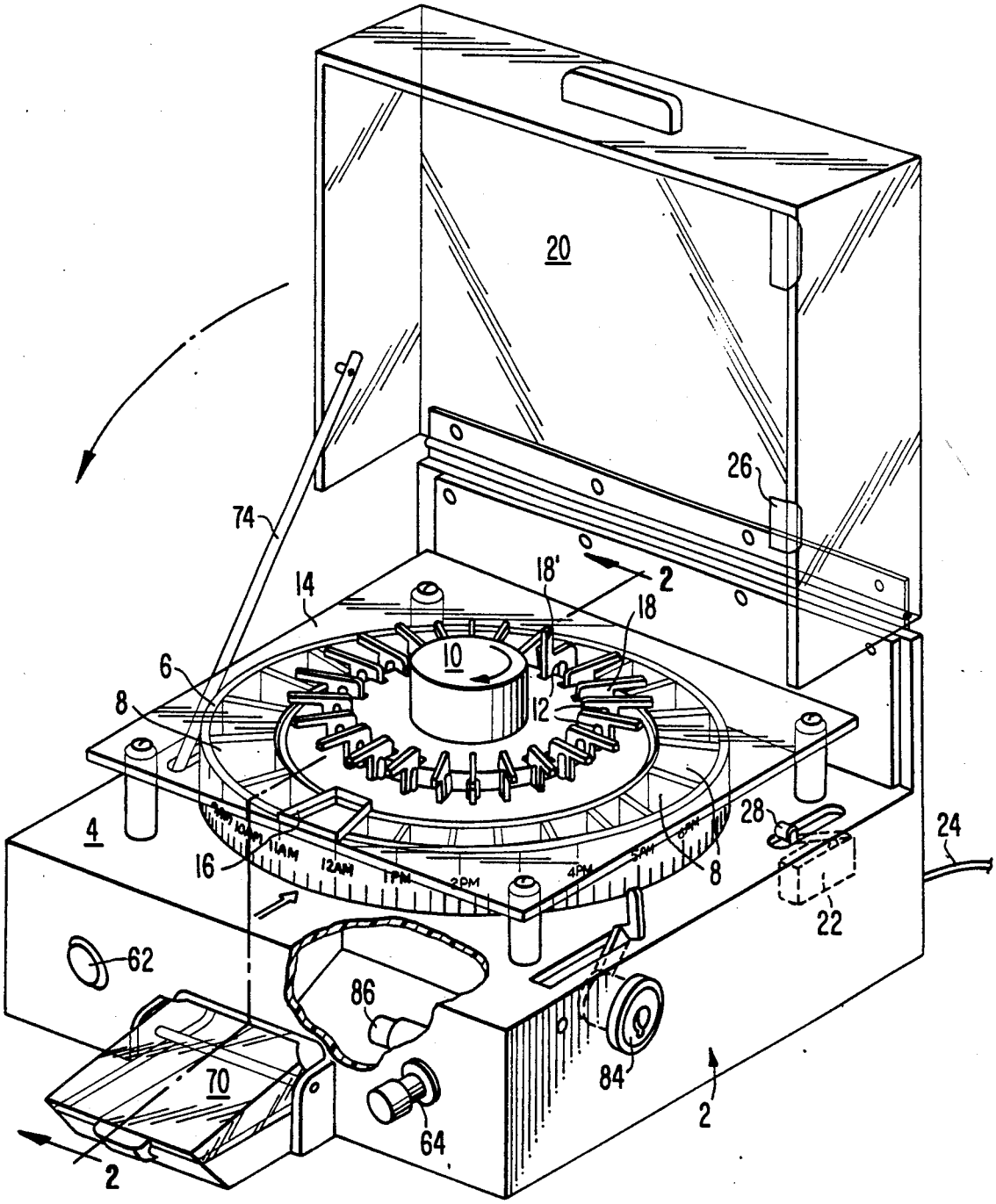
FIG. 1 is a perspective view of a dispenser in accordance with the invention.

FIG. 1 shows a perspective of the invention having a portion partially cut away. A base member 2 includes an upper surface 4. An annular element 6 provides a plurality of open compartments 8 for receiving pills. Preferably, there are twenty-four compartments 8, but it will be apparent that any number of compartments 8 may be used.

Annular element 6 is mounted for rotation with respect to base 2 as will be made more clear in the description of FIG. 2 below. Compartments 8 are open at their tops and bottoms, and annular element 6 is mounted adjacent upper surface 4 of base 2 so that pills placed in the compartments are retained therein by surface 4 as the annular element 6 rotates. Upper surface 4 has an opening (FIG. 2) for allowing contents of a compartment to be dispensed when annular element 6 is in a pre-selected position, as will be more apparent from FIG. 2. Knob 10 and pins 12 rotate with annular element 6, and knob 10 allows a user to rotate annular element 6 for loading pills or otherwise adjusting its position. A cover 14 is attached to base 2 and covers all of the compartments 8 except for the compartment aligned with opening 16 formed in cover 14. It will be appreciated that when it is desired to load pills into the various compartments, annular element 6 is rotated by knob 10 to align sequentially selected compartments with opening 16 so that pills may be placed in the selected compartment.

Pins 12 may be placed in activated or inactivated positions depending upon the orientation of cam members 18. In FIG. 1, cam member 18' is shown in an activated position, while the remainder of the cams are shown in their inactivated positons.

The outer surface of annular element 6 preferably has time indications, and upper surface 4 includes an index mark adjacent the time indications for indicating when a compartment will be in a dispensing position.

A lid 20 covers annular element 6 and cover 14 in one position and exposes these elements in the position shown in FIG. 1. Annular element 6 is rotated by an electric clock motor, and switch 22 is placed in series with one conductor of power cord 24 to deactivate all electrical components of the apparatus when the lid 20 is opened. A small protrusion 26 on a sidewall of lid 20 engages a lever 28 of switch 22 when the lid is in a closed position.

Figure 2:
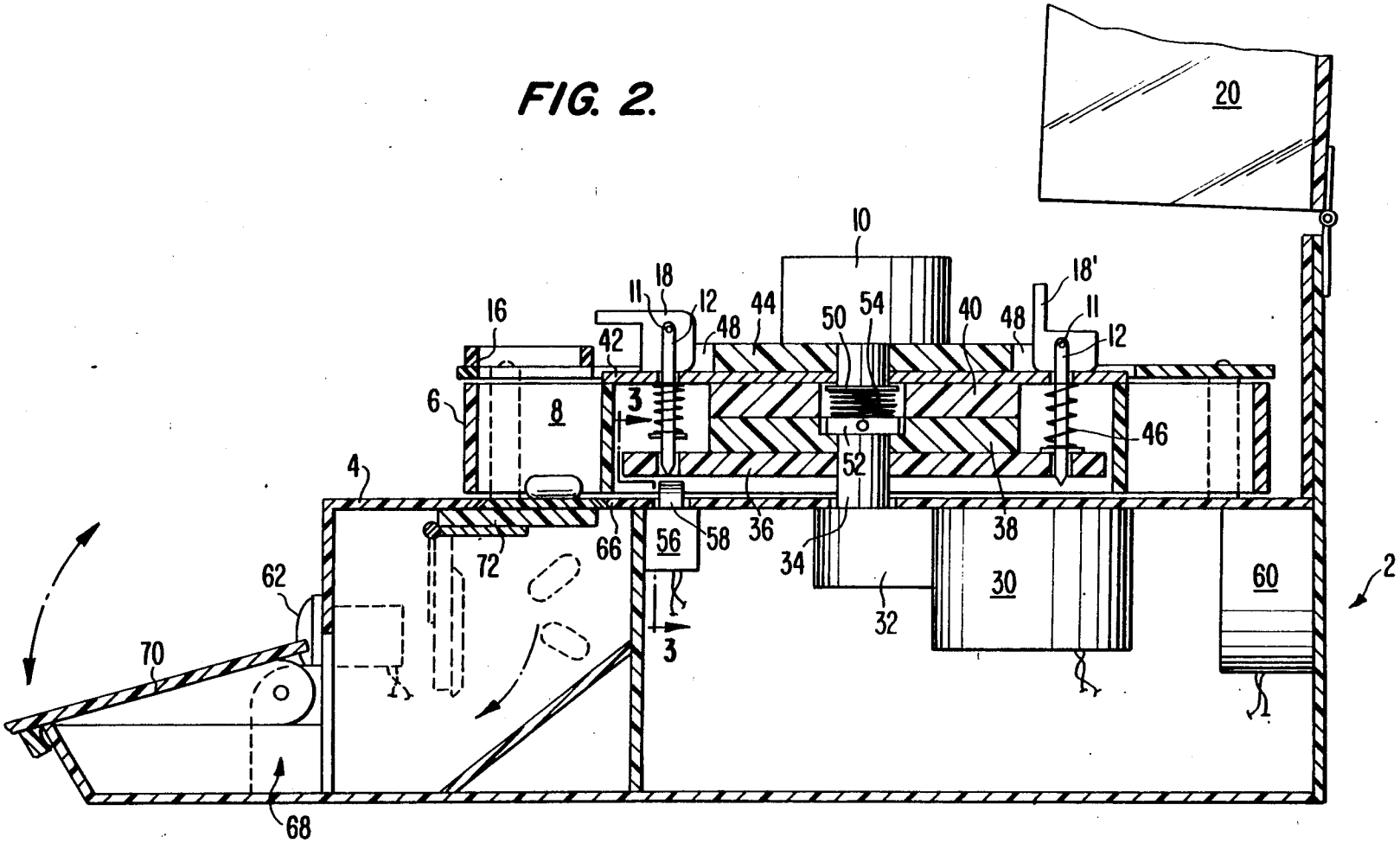
FIG. 2 is a cross section taken along line 2—2 of FIG. 1.

With reference to FIG. 2, the operative components of the apparatus will be described. An electric clock motor 30 is secured to the base 2 and operates through a gear mechanism 32 to rotate shaft 34. Shaft 34 extends upwardly through apertures in lower guide plate 36, separator plates 38 and 40, upper guide plate 42 and cam guide plate 44. Shaft 34 also extends into a recess (not shown) in knob 10, but is not secured to knob 10.

Pins 12 ride in apertures in upper and lower guide plates 36 and 42 and are urged downwardly by springs 46. Cam members 18 are pivotable about an upper connection between pins 12 and cam member 18 to raise or lower the pins 12. Cam members are preferably shaped to provide a visual indication of their positions, such as by the illustrated elongate flags. The cams are held in radial positions by grooves 48 in cam guide 44. Screws (not shown) secure knob 10, cam guide 44, upper and lower guide plates 42, 36, and separator plates 38, 40 together to rotate as a single unit. Motor 30 drives this unit by rotating shaft 34, which engages the unit at the bottom surface of upper guide plate 42 by friction washer 50. The frictional force between friction washer 50 and upper guide plate 42 is adjusted by adjusting the position of collar 52 on shaft 34 to alter tension in spring 54.

A microswitch 56 includes a lever 58 which extends through an opening in surface 4 and is engageable by the lower points of pins 12 when cam a member 18 is in an activated position as shown at 18'. When a pin 12 engages lever 58, audio alarm 60 and visual alarm 62 are activated. The microswitch receives its power from a delay-on-release relay (not shown) which is also connected to shut-off switch 64 (see FIG. 1). When switch 56 is activated by movement of lever 58, the alarms are activated, thus alerting a patient to take the pills. When the patient has taken the pills, he depresses shut-off switch 64 which deactivates the relay, thus removing power from switch 56 and turning off the alarms. The relay has a built-in delay which causes it to wait a predetermined amount of time before again arming itself automatically. This period of time allows for pin 12 to move and for lever 58 to assume an inactivated position.

When a compartment 8 having pills therein is located above opening 66 in upper surface 4, the pills fall through the opening and into dispensing chute 68. Then, door 70 is opened and the pills are removed. Chute light 86 (FIG. 1) illuminates the chute for easy use in a dark room.

Opening 66 is shown in FIG. 2 closed by trapdoor 72. When lid 20 is closed, trapdoor 72 is rotated into the position shown in dotted lines shown in FIG. 2 by the mechanism shown in FIG. 4 which will be more fully described below.

FIG. 3 is a detailed drawing showing a cross section taken along line 3—3 of FIG. 2. This illustrates how pins 12 engage lever 58 of switch 56 when they extend below lower guide plate 36.

FIG. 4 illustrates the operation of trapdoor 72. A control arm 74 is pivotally connected to a sidewall of lid 20 and to a control lever 76. Control lever 76 is secured to axle 78 which is pivotably mounted to base 2. Trapdoor 72 is also secured to axle 78 for rotation therewith. A tension lever 80 is secured to axle 78 and also to spring 82 for holding lid 20 in the raised position.

It will be appreciated that as the control arm 74 moves downwardly when lid 20 is closed, axle 78 rotates in the direction of the arrow shown in FIG. 4, thus causing trapdoor 72 to rotate from the position shown in solid lines in FIG. 2 to that shown in dotted lines. Conversely, when lid 20 is raised, trapdoor 72 rotates to the position shown in solid lines in FIG. 2, thus preventing the dispensing of pills.

A lock 84 (FIG. 1) is used to secure the lid 20 in the closed position after pills have been loaded.

OPERATION

In operation, pills are loaded in accordance with a prescription by releasing lock 84 and raising lid 20. This causes trapdoor 72 to cover opening 66 and also removes power from the electric motor and alarm circuits. Then, annular element 6 is rotated by use of knob 10 to position any selected compartment 8 below opening 16, and appropriate pills are loaded into the selected compartment. The index marking on base 8 and the clock ring on annular element 6 are used to determine the compartment which will correspond to the time designated for the patient's taking the selected pills.

As the pills are being loaded into a selected compartment 8, a cam member 18 associated with that compartment is rotated to the position shown at 18' in FIG. 1. This extends pin 12 below the lower guide plate 36 to allow the pin to engage lever 58 when that selected compartment is adjacent opening 66. Cam members 18 are not automatically reset when pills are dispensed, the upraised flags thus providing an additional indication to the patient or physician of which compartments have been selected for receiving the pills.

After the pills are loaded, the knob 10 is rotated to align the index marking on base 4 with the correct present time indicated on annular element 6. Lid 20 is then closed and locked. When the lid is closed, switch 22 is activated to cause motor 30 to rotate annular element 6. Because opening 66 is now not blocked by trapdoor 72, when a compartment containing pills is aligned with an opening, the pills fall into dispensing chute 68. At the same time, pins 12, which have been set earlier, engage lever 58 thus causing audible and visual alarms to be activated.

At this point, the patient is alerted to take the pills which have been dispensed into the chute, and the patient depresses shut-off switch 64 when the pills are taken. This causes the delay-on-release to deactivate the alarms for a period of time sufficient for the pin 12 to release lever 58. Then, the relay automatically re-arms and the apparatus is ready for dispensing the next set of pills.

It will be appreciated that a simple and yet highly effective apparatus for dispensing pills has been described. Modifications within the scope of the apparended claims will be apparent to those of skill in the art.

What is claimed is:

1. A dispenser comprising (a) a base, (b) compartment means forming a plurality of compartments and mounted on said base for rotation with respect to said base, wherein said compartments are open at their tops and bottoms, the lower surface of said compartment means being adjacent a surface of said base to close the bottoms of at least one said compartment, (c) clock means for driving said compartment means in rotation, (d) chute means for dispensing contents of said compartments, ssid chute means being beneath an opening in said surface of said base, said opening being located with respect to said compartment means to be aligned with a single said compartment for any selected rotational position of said compartment means, (e) alarm means comprising pin means associated with each of said compartments, switch means, and sensible means, said pin means being carried by said compartment means and having first and second selectable positions, said pin engaging said switch means for a said selected rotational position of said compartment means when in said first position and not engaging said switch means when in said second position, and said sensible means being activated by said switch means, (f) cover means attached to said base for covering an upper surface of said compartment means, said cover means having an opening for allowing access to a selected one of said compartments, said opening in said cover means being aligned with said opening in said surface of said base, and wherein said pin means comprises an elongate element attached at an upper end to an eccentric cam and having a lower end for engaging said switch means for a selected position of said cam.

2. A dispenser according to claim 1 wherein said eccentric cam includes flag means for visually indicating the orientation of said eccentric cam.

3. A dispenser according to claim 1 further comprising clutch means connecting said clock means and said compartment means.

4. A dispenser comprising (a) a base, (b) compartment means forming a plurality of compartments and mounted on said base for rotation with respect to said base, wherein said compartments are open at their tops and bottoms, the lower surface of said compartment means being adjacent a surface of said base to close the bottoms of at least one said compartment, (c) clock means for driving said compartment means in rotation, (d) chute means for dispensing contents of said compartments, said chute means being beneath an opening in said surface of said base, said opening being located with respect to said compartment means to be aligned with a single said compartment for any selected rotational position of said compartment means, (e) alarm means comprising pin means associated with each of said compartments, switch means, and sensible means, said pin means being carried by said compartment means and having first and second selectable positions, said pin engaging said switch means for a said selected rotational position of said compartment means when in said first position and not engaging said switch means when in said second position, and sensible means being activated by said switch means, and (f) lid means for enclosing said compartment means, door means for selectively covering said opening in said surface of said base, and means connecting said lid means and said door means such that said door means cover said opening in said surface of said base when said lid means is in a position exposing said compartment means.

* * * * *